US008141999B2

(12) United States Patent
Takagi

(10) Patent No.: US 8,141,999 B2
(45) Date of Patent: Mar. 27, 2012

(54) VALVE MECHANISMS AND INK CARTRIDGES

(75) Inventor: Yuki Takagi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 715 days.

(21) Appl. No.: 12/325,524

(22) Filed: Dec. 1, 2008

(65) Prior Publication Data

US 2009/0141101 A1 Jun. 4, 2009

(30) Foreign Application Priority Data

Nov. 30, 2007 (JP) ..... 2007-311732
Dec. 1, 2007 (JP) ..... 2007-311820

(51) Int. Cl.
*B41J 2/175* (2006.01)

(52) U.S. Cl. ..... 347/86; 347/84

(58) Field of Classification Search ..... 347/84, 347/85, 86, 87; 137/247.11, 247.13, 247.17
See application file for complete search history.

(56) References Cited

U.S. PATENT DOCUMENTS

| | | | | |
|---|---|---|---|---|
| 6,390,611 | B1 * | 5/2002 | Kobayashi et al. | 347/84 |
| 6,837,575 | B2 * | 1/2005 | Usui | 347/85 |
| 6,929,357 | B2 * | 8/2005 | Qingguo et al. | 347/85 |
| 7,011,397 | B2 * | 3/2006 | Miyazawa et al. | 347/86 |
| 2007/0070147 | A1 | 3/2007 | Hattori et al. | |

FOREIGN PATENT DOCUMENTS

JP 2007-144808 A 6/2007

* cited by examiner

*Primary Examiner* — Anh T. N. Vo
(74) *Attorney, Agent, or Firm* — Baker Botts L.L.P.

(57) ABSTRACT

A valve mechanism includes a particular wall having a first opening formed therethrough, and a tube member including a particular surface which contacts the particular wall, and a central axis. The valve mechanism also includes a lid member configured to selectively cover and uncover the first opening, and a flexible inner wall positioned in an interior of the tube member. The flexible inner wall extends from the tube member to the lid member in a direction which intersects the central axis, and the flexible inner wall has a second opening formed therethrough. Moreover, a cross-sectional shape of the flexible inner wall in a particular plane is bent, and the central axis lies on the particular plane.

22 Claims, 8 Drawing Sheets

VALVE MECHANISMS AND INK CARTRIDGES

CROSS-REFERENCE TO RELATED APPLICATIONS

The present application claims priority from Japanese Patent Application No. JP-2007-311732, which was filed on Nov. 30, 2007, and Japanese Patent Application No. JP-2007-311820, which was filed on Dec. 1, 2007, the disclosures of which are incorporated herein by reference in their entirety.

BACKGROUND OF THE INVENTION

1. Field of the Invention

The present invention relates generally to valve mechanisms and ink cartridges comprising such valve mechanisms.

2. Description of Related Art

A known ink-jet image recording apparatus has a recording head and an ink supply device configured to supply ink to the recording head. A known ink cartridge is configured to be mounted to the ink supply device. The known ink cartridge has a case, and the case has an ink chamber formed therein. The ink chamber is configured to store ink therein. The case has an ink supply portion, and ink is supplied from an interior of the ink chamber to an exterior of the ink chamber via the ink supply portion. When the known ink cartridge is mounted to the ink supply device, ink stored in the ink chamber is supplied to the recording head via the ink supply portion. The recording head is configured to selectively eject ink toward a sheet of paper, such that an image is recorded on the sheet. The known ink cartridge also has a check valve positioned adjacent to the ink supply portion, and the check valve is configured to prevent ink from returning from the recording head to the ink chamber.

Another known ink cartridge, such as the ink cartridge described in JP-A-2007-144808, has an ink supply portion. The interior of the ink supply portion is partitioned from an ink chamber by a particular wall. The particular wall has an opening formed therethrough, and the interior of the ink supply portion is configured to be in fluid communication with the ink chamber via the opening of the particular wall. The another known ink cartridge also has a check valve element and a cover positioned in the interior of the ink supply portion. The check valve element has a substantially umbrella shape, and has a canopy portion and a handle portion. The cover has a first opening formed therethrough and a plurality of second openings formed therethrough. The handle portion is inserted through the first opening, and the second openings are configured to allow ink to flow therethrough. The cover contacts the particular wall. When the pressure in the ink chamber is greater than the pressure in the interior of the ink supply portion, the canopy portion receives a pressure from ink, and the check valve element moves, such that the canopy portion moves away from the cover. Because the second openings are uncovered, the ink flows from the ink chamber to the interior of the ink supply portion. In contrast, when the pressure in the ink chamber is less than the pressure in the interior of the ink supply portion, the canopy portion receives a pressure from ink, and the check valve element moves, such that the canopy portion moves toward the cover. Accordingly, the second openings are closed by the canopy portion, and the flow of ink from the interior of the ink supply portion toward the ink chamber is prevented.

Nevertheless, when the check valve element moves, the handle portion receives a resistance from the cover because the handle slides on the cover in the first opening. Therefore, when the amount of ink flow is relatively small, e.g., when the pressure differential between the ink chamber and the interior of the ink supply portion is relatively small, the check valve element may not move properly.

SUMMARY OF THE INVENTION

Therefore, a need has arisen for valve mechanisms and ink cartridges which overcome these and other shortcomings of the related art. A technical advantage of the present invention is that a sensitivity of a valve mechanism to a pressure differential may be increased.

According to an embodiment of the present invention, a valve mechanism comprises a particular wall having a first opening formed therethrough, and a tube member comprising a particular surface which contacts the particular wall, and a central axis. The valve mechanism also comprises a lid member configured to selectively cover and uncover the first opening, and a flexible inner wall positioned in an interior of the tube member. The flexible inner wall extends from the tube member to the lid member in a direction which intersects the central axis, and the flexible inner wall has a second opening formed therethrough. Moreover, a cross-sectional shape of the flexible inner wall in a particular plane is bent, and the central axis lies on the particular plane.

According to another embodiment of the present invention, an ink cartridge comprises an ink chamber configured to store ink therein, a particular chamber configured to supply ink from an interior of the ink chamber to the exterior of ink chamber therethrough, and a particular wall having a first opening formed therethrough. The ink chamber and the particular chamber are divided by the particular wall. The ink cartridge also comprises a tube member comprising a particular surface which contacts the particular wall, and a central axis. Moreover, the ink cartridge comprises a lid member configured to selectively cover and uncover the first opening, and a flexible inner wall positioned in an interior of the tube member. The flexible inner wall extends from the tube member to the lid member in a direction which intersects the central axis, and the flexible inner wall has a second opening formed therethrough. In addition, a cross-sectional shape of the flexible inner wall in a particular plane is bent, and the central axis lies on the particular plane.

Other objects, features, and advantages of embodiments of the present invention will be apparent to persons of ordinary skill in the art from the following description of embodiments with reference to the accompanying drawings.

BRIEF DESCRIPTION OF DRAWINGS

For a more complete understanding of the present invention, the needs satisfied thereby, and the objects, features, and advantages thereof, reference now is made to the following description taken in connection with the accompanying drawings.

DETAILED DESCRIPTION OF EMBODIMENTS

Figure 1B:
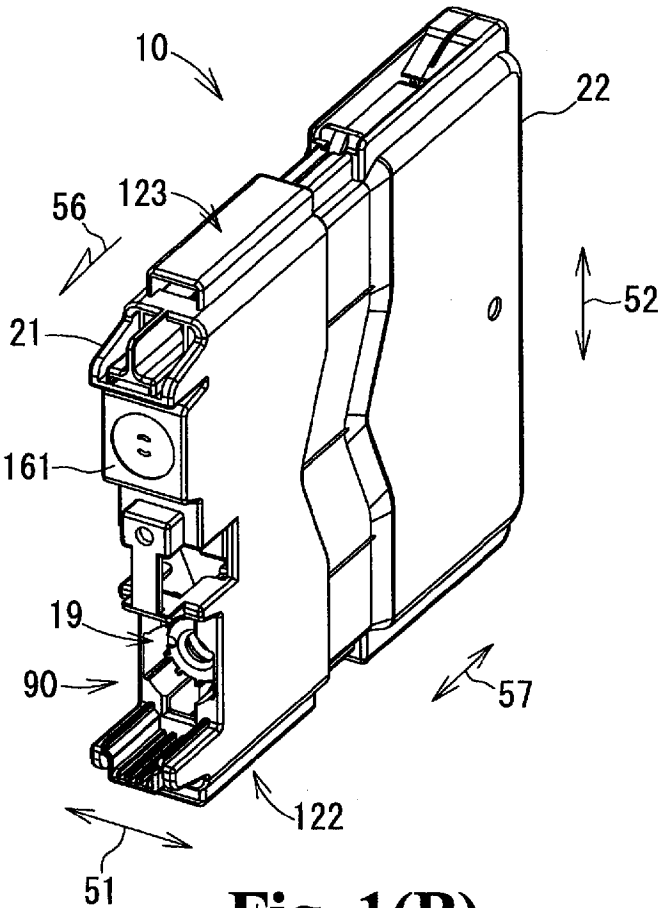
FIGS. 1(A) and 1(B) are perspective views of an ink cartridge, according to an embodiment of the present invention, in which a first cover of the ink cartridge is in a second position and a first position, respectively.

Embodiments of the present invention and their features and technical advantages may be understood by referring to FIGS. 1-8(B), like numerals being used for like corresponding portions in the various drawings.

Referring to FIGS. 1(A)-3, an ink cartridge 10 according to an embodiment of the present invention is described. Ink cartridge 10 may be configured to be used with an ink-jet image recording apparatus (not shown). The ink-jet image recording apparatus may comprise a recording head (not shown) and an ink supply device configured to supply ink to the recording head. The ink supply device may comprise a mounting portion (not shown), and ink cartridge 10 may be configured to be removably mounted to the mounting portion.

Ink cartridge 10 may have a flattened, substantially rectangular parallelepiped shape having a width in a width direction 51, a height in a height direction 52, and a depth in a depth direction 57. The width of ink cartridge 10 may be less than each of the height of ink cartridge 10 and the depth of ink cartridge 10.

Ink cartridge 10 may be inserted into the mounting portion in an insertion direction 56, which is parallel to depth direction 57. Ink cartridge 10 may comprise a top face 123 and a bottom face 122 opposite top face 123. When ink cartridge 10 is mounted to the mounting portion, ink cartridge 10 is in a position depicted in FIG. 1, i.e., top face 123 is positioned at the top of ink cartridge 10, and bottom face 122 is positioned at the bottom of ink cartridge 10.

Ink cartridge 10 may comprise a case 20, a first cover 21, and a second cover 22. First cover 21 and second cover 22 may define substantially an entirety of the outer appearance of ink cartridge 10. Case 20 may comprise an ink chamber 100 formed therein, and ink chamber 100 may be configured to store ink therein. First cover 21 and second cover 22 may enclose substantially the entirety of case 20. In this embodiment, case 20, first cover 21, and second cover 22 may comprise a resin material, such as nylon, polyethylene, polypropylene, or any combination thereof.

Figure 2:
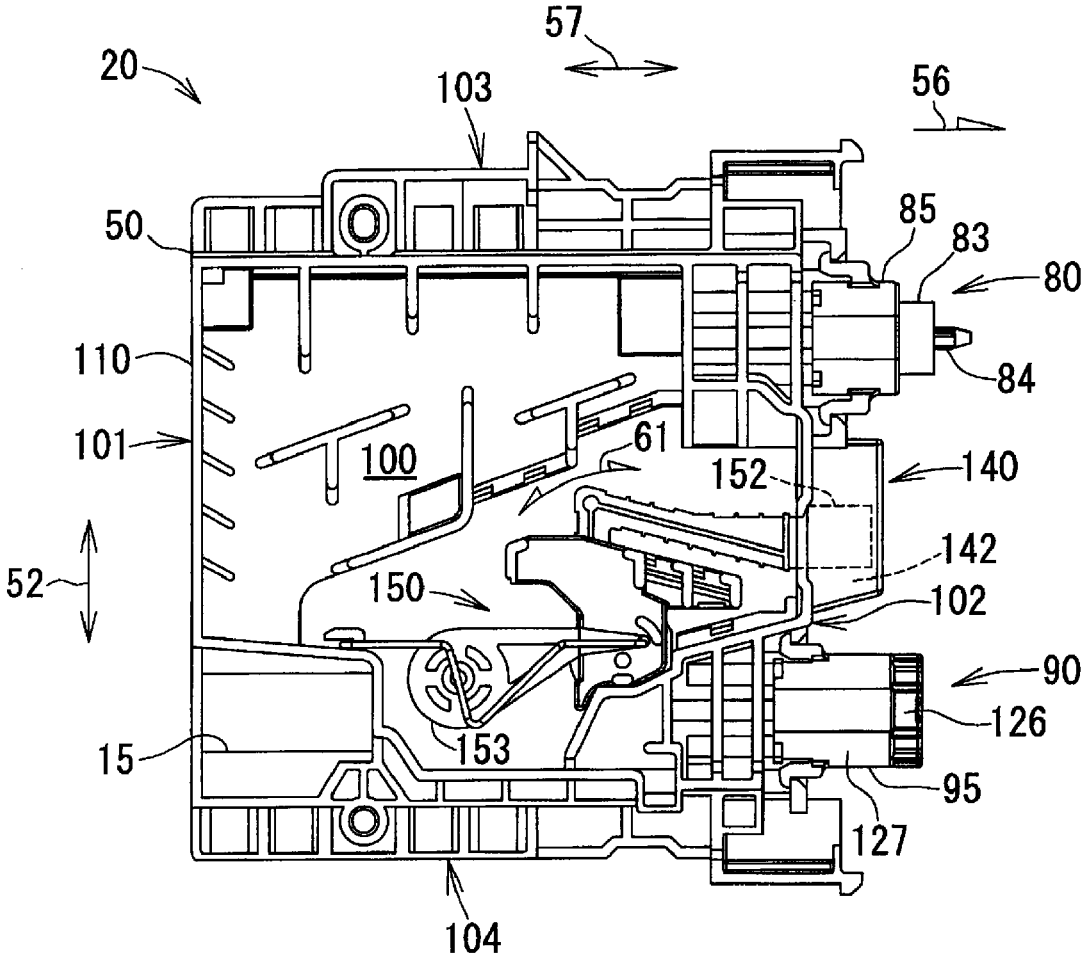
FIG. 2 is a side view a case of the ink cartridge of FIGS. 1(A) and 1(B).
Figure 3:
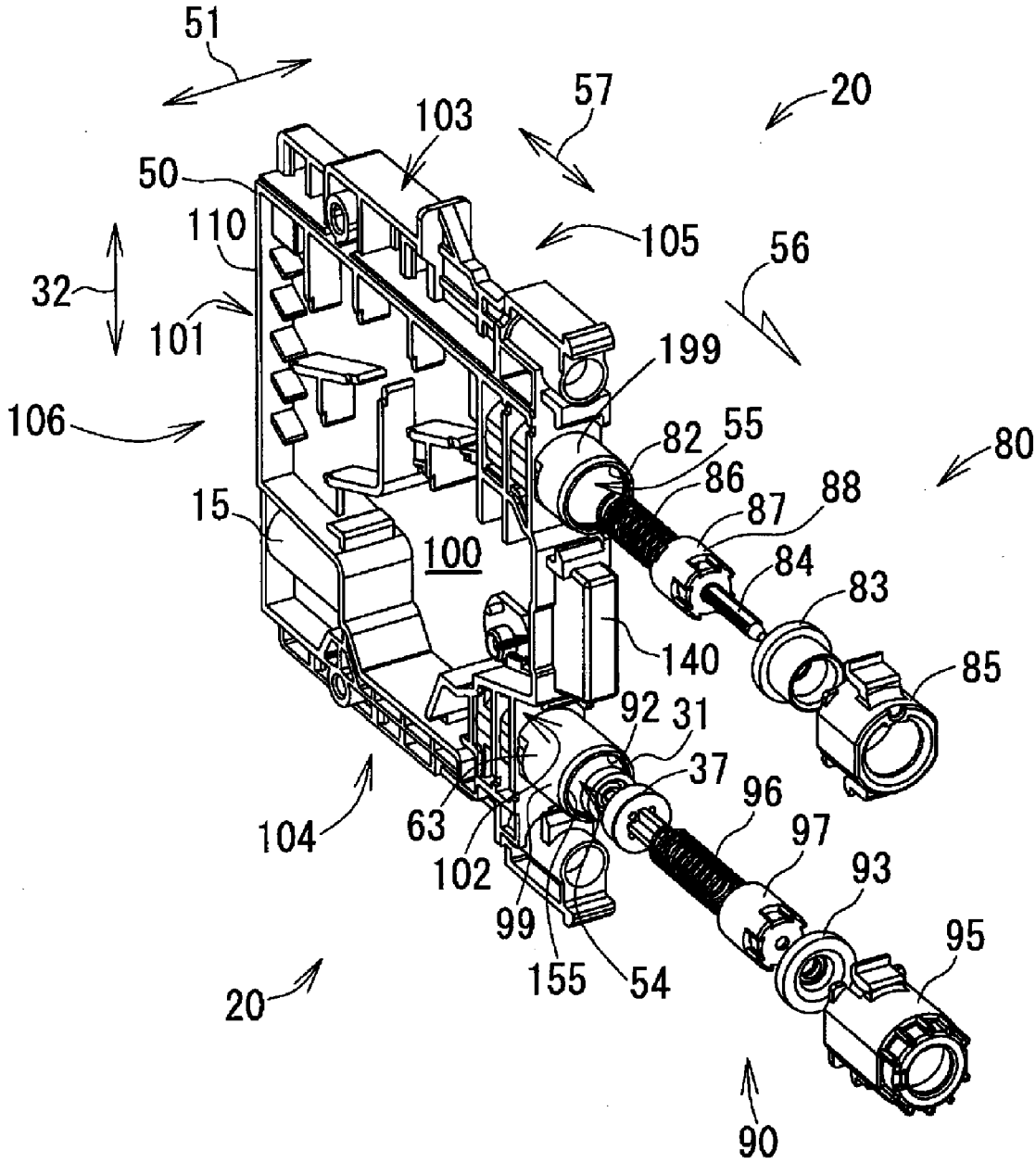
FIG. 3 is an exploded, perspective view of the case of FIG. 2, in which a pivotable member is omitted.

Referring to FIGS. 2 and 3, case 20 may comprise a front face 102, a rear face 101 positioned opposite front wall 102, a top face 103 extending between front face 102 and rear face 101, a bottom face 104 extending between front face 102 and rear face 101 and positioned opposite top face 103, a left face 105 extending between front face 102 and rear face 101, and a right face 106 extending between front face 102 and rear face 101 and positioned opposite left face 105. Each of front face 102, rear face 101, top face 103, bottom face 104, left face 105, and right face 106 may face the exterior of case 20, and may define the outer appearance of case 20. When ink cartridge 10 is inserted into the mounting portion, case 20 may be inserted from a front face 102 side. When the ink cartridge 10 is mounted to the mounting portion and is used in the image recording apparatus, top face 103 is positioned at the top of case 20 and bottom face 104 is positioned at the bottom of case 20. Each of an area of left face 105 and an area of right face 106 may be greater than each of an area of front face 102, an area of rear face 101, an area of top face 103, and an area of bottom face 104.

Ink cartridge 10 also may comprise an air communication valve mechanism 80, an ink supply valve mechanism 90, and a pivotable member 150.

Case 20 may comprise a frame 110 and a pair of films (not shown). Frame 110 may comprise front face 102, rear face 101, top face 103, and bottom face 104. The pair of films may comprise left face 105 and right face 106, respectively.

Frame 110 may comprise a translucent resin material, e.g., a transparent or semi-transparent resin material, such as polyacetal, nylon, polyethylene, polypropylene, or the like, and may be manufactured by injection molding the resin material.

Frame 110 may have substantially a rectangular profile extending along front face 102, top face 103, rear face 101, and bottom face 104, forming a space inside. As a result, a pair of openings may be formed at widthwise ends of the frame 110, respectively.

The pair of films may be attached, e.g., welded or bonded with adhesive, to the widthwise ends of frame 110, respectively, such that the openings are covered by the pair of films, respectively. Frame 110 and the pair of films may define an ink chamber 100 therein. Ink chamber 100 may be configured to store ink therein. In another embodiment, a frame may be a container having six rigid walls, and an ink chamber may be formed in the container.

Referring to FIGS. 2 and 3, frame 110 may comprise an ink filling portion 15 positioned at rear face 101. Ink filling portion 15 may comprise substantially a circular, cylindrical chamber extending from rear surface 101 toward ink chamber 100. The cylindrical chamber of ink filling portion 15 may be configured to be in fluid communication with ink chamber 100. When ink cartridge 10 is manufactured, ink may be introduced into ink chamber 100 via ink filling portion 15, such that ink chamber 100 is filled with ink.

Case 20 may comprise a detection portion 140 extending from front face 102 away from ink chamber 100. The amount of ink stored in ink chamber 100 may be visually or optically detected via detection portion 140. Detection portion 140 may be integral with frame 110. Therefore, detection portion 140 may comprise the same material as frame 110, i.e., a translucent resin material, e.g., a transparent or a semi-transparent resin material. Light may pass through detection portion 140. When ink cartridge 10 is mounted to the mounting portion, detection portion 140 may be irradiated with light emitted from an optical sensor, e.g., a photo-interrupter, positioned in the mounting portion. Detection portion 140 may have an inner space 142 formed therein. Inner space 142 may be continuous with ink chamber 100.

Pivotable member 150 may be positioned in ink chamber 100. Pivotable member 150 may comprise an indicator portion 152 at a first end of pivotable member 150. Indicator portion 152 may be positioned in inner space 142 and may be configured to move in inner space 142. Pivotable member 150 may comprise a float portion 153 at a second end of pivotable member 150. Pivotable member 150 may be pivotably supported by case 20 at a position between indicator portion 152 and float portion 153, such that pivotable member 150 pivots in directions indicated by an arrow 61 in FIG. 2. The specific gravity of float portion 153 may be less than the specific gravity of ink stored in ink chamber 100. For example, float portion 153 may comprise a hollow formed therein, such that the specific gravity of float portion 153 is less than the specific gravity of ink stored in ink chamber 100. Therefore, float portion 153 may be configured to float on ink and to move up and down according to an increase or a decrease of the amount of ink in ink chamber 100, respectively. Pivotable member 150 may pivot in accordance with the movement of float portion 153, and indicator portion 152 may move in inner space 142 in accordance with the pivotal movement of pivotable member 150. The position of indicator portion 152 in inner space 142 may be detected by the optical sensor, or may be detected visually, from the exterior of detection portion 140. It may be determined whether the amount of ink in ink chamber 100 is greater than or equal to a predetermined amount, based on the position of indicator portion 152.

Figure 1A:
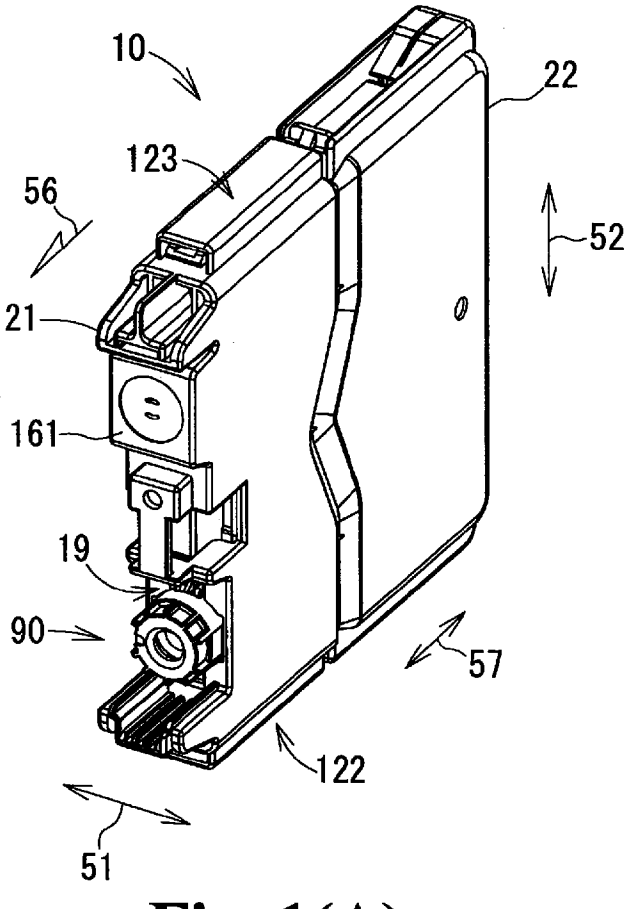

Referring to FIGS. 1(A) and 1(B), first cover 21 may have a container shape and may accommodate a front portion of case 20 with respect to insertion direction 56, i.e., first cover 21 may accommodate front face 102 side of case 20. Second cover 22 may have a container shape and may accommodate a rear portion of case 20 with respect to insertion direction 56, i.e., second cover 22 may accommodate rear face 101 side of case 20. Accordingly, the front portion of case 20 may be protected by first cover 21, and the rear portion of case 20 may be protected by second cover 22.

First cover 21 may comprise a front wall 161 facing front face 102 of case 20, and an opening 19 may be formed through front wall 161. First cover 21 may be configured to slide in depth direction 57 with respect to second cover 22. In FIG. 1(A), first cover 21 is in a second position in which front wall 161 is positioned closest to front face 102 of case 20 within the sliding range of first cover 21. In FIG. 1(B), first cover 21 is in a first position in which front wall 161 is positioned furthest from front face 102 of case 20 within the sliding range of first cover 21.

Coil springs (not shown) may be positioned between front wall 161 of first cover 21 and front face 102 of case 20. The coil springs may apply a biasing force to first cover 21 toward the first position. Accordingly, when no external force is applied to first cover 21, the coil springs may bias first cover 21 into the first position. When an external force is applied to first cover 21 against the biasing force of the coil springs, first cover 21 may move from the first position to the second position.

Figure 4:
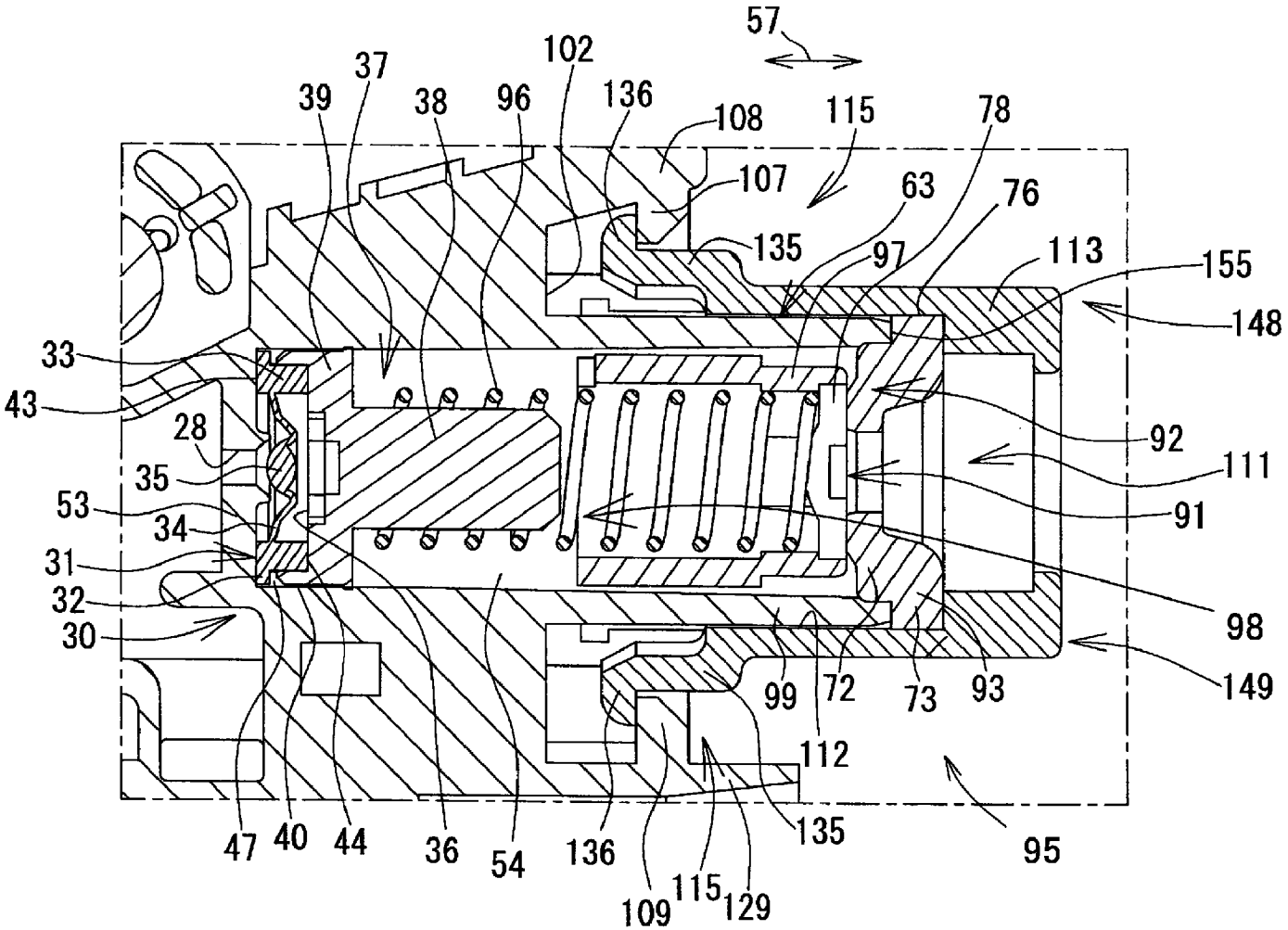
FIG. 4 is a partial, cross-sectional view of the case of FIG. 2, showing a structure adjacent to an ink supply wall of the case, in which an ink supply opening is covered.
Figure 5:
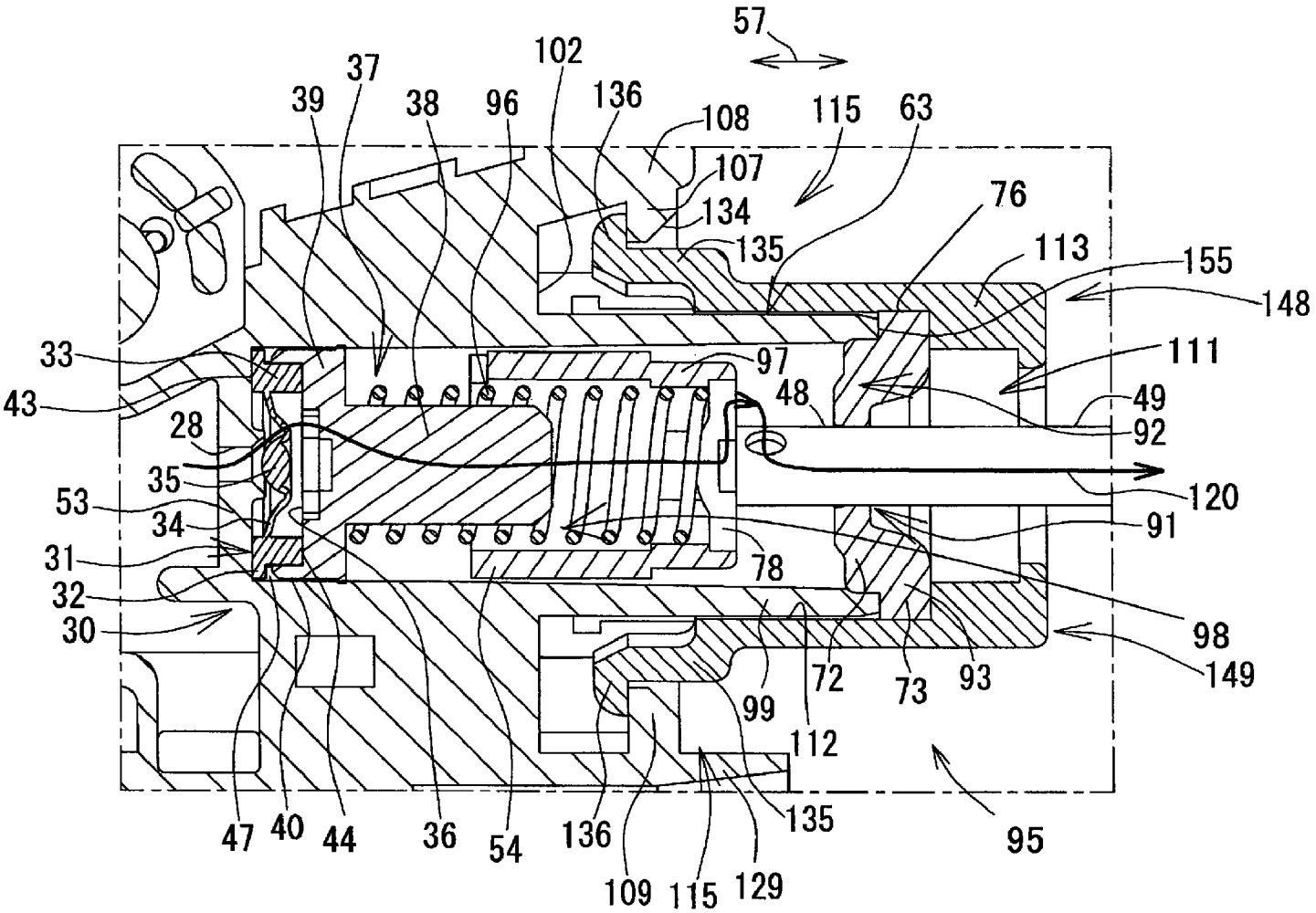
FIG. 5 is a partial, cross-sectional view of the case of FIG. 2, showing a structure adjacent to the ink supply wall of the case, in which the ink supply opening is uncovered.

Referring to FIG. 4, an opening 98 may be formed through front face 102 of case 20. Opening 98 may be positioned closer to bottom face 104 than to top face 103. Referring to FIGS. 3 and 4, case 20 may comprise an ink supply wall 99 extending from a particular portion of front face 102, which portion surrounds opening 98, toward the exterior of case 20 in depth direction 57. The particular portion of front face 102 may surround opening 98. Ink supply wall 99 may have a tube shape, e.g., a circular, cylindrical tube shape. In another embodiment, ink supply wall 99 may have a rectangular, cylindrical tube shape. Referring to FIG. 4, a valve chamber 54 may be formed in ink supply wall 99, and valve chamber 54 may extend from the interior of ink supply wall 99 to the interior of case 20 beyond front face 102 via opening 98. Valve chamber 54 may extend in depth direction 57. In an embodiment, valve chamber 54 may have a circular cylindrical shape. Case 20 may comprise an end wall 53 defining the inner most end of valve chamber 54, and an opening 28 may be formed through end wall 53. Valve chamber 54 may be configured to be in fluid communication with ink chamber 100 via opening 28. At least a portion of ink supply valve mechanism 90 may be accommodated in valve chamber 54.

Referring to FIGS. 3 and 4, an opening 92 may be formed at and through an end 155 of ink supply wall 99 opposite opening 98. Ink supply valve mechanism 90 may be configured to selectively allow and prevent fluid communication between the interior of ink chamber 100 and the exterior of case 20 via opening 92 and valve chamber 54. Ink supply valve mechanism 90 may comprise a first valve element 31, a valve seat 37, a coil spring 96, a second valve element 97, a sealing member 93, and a cap 95. Each of first valve element 31, valve seat 37, coil spring 96, second valve element 97, sealing member 93, and cap 95 may comprise a resin, such as polyacetal or silicon rubber.

First valve element 31, valve seat 37, coil spring 96, second valve element 97, sealing member 93, and cap 95 may be sequentially aligned in depth direction 57 and may contact each other. First valve element 31, valve seat 37, coil spring 96, and second valve element 97 may be accommodated in valve chamber 54. Sealing member 93 and cap 95 may be positioned at end 155 of ink supply wall 99.

Referring to FIG. 4, ink cartridge 10 may comprise a valve mechanism 30 comprising end wall 53, first valve element 31, and valve seat 37.

First valve element 31 may be manufactured by injection-molding an elastic material, such as silicon rubber. First valve element 31 may be a relatively small member, and therefore, first valve element 31 may comprise a coloring agent, such as a pigment or a pigment dispersant, such that first valve element 31 is visibly recognizable and readily may be positioned at end wall 53 when ink cartridge 10 is manufactured. Nevertheless, the pigment dispersant may be transferred from first valve element 31 to the ink, and that transferred pigment dispersant may change the physical properties of the ink. Therefore, in another embodiment, first valve element 31 may not comprise any coloring agents. In an embodiment, first valve element 31 may comprise only silicon rubber, and may have the original color of silicone rubber, e.g., may be transparent or semi-transparent.

Figure 6:
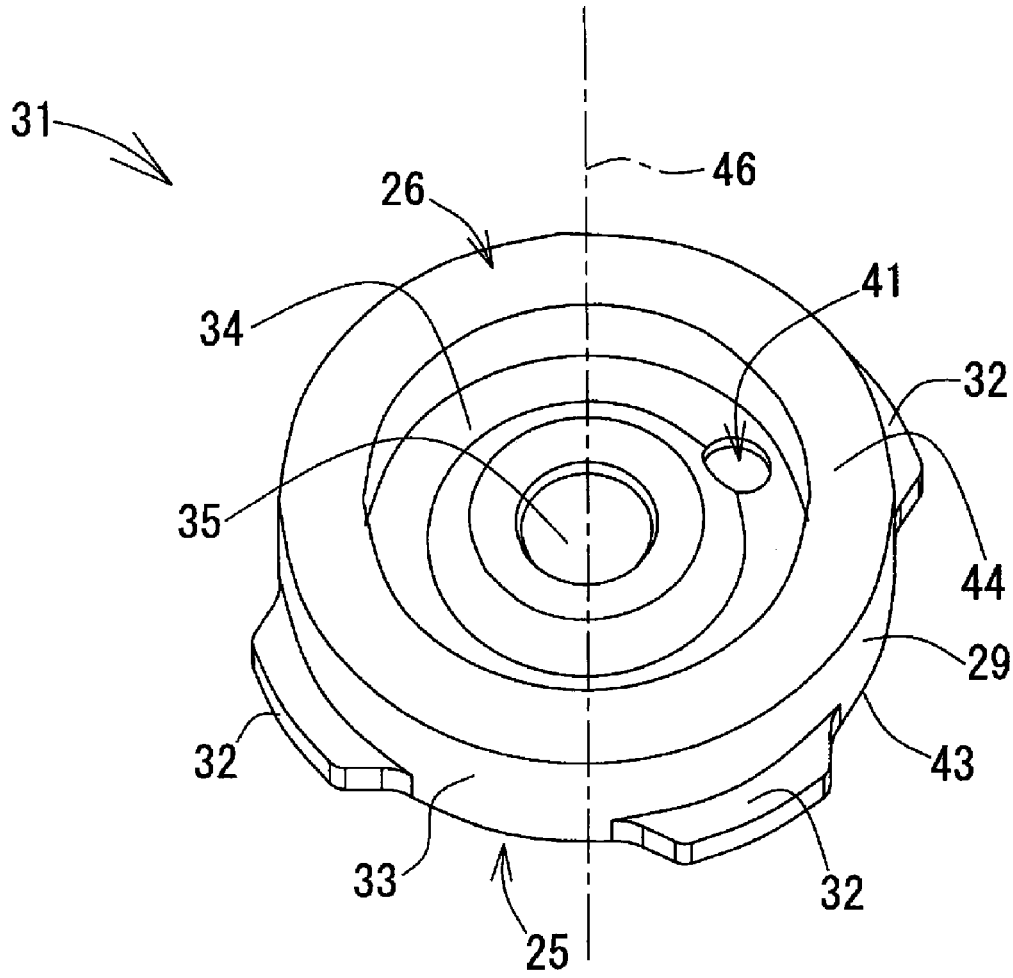
FIG. 6 is a perspective view of a first valve element.
Figure 7:
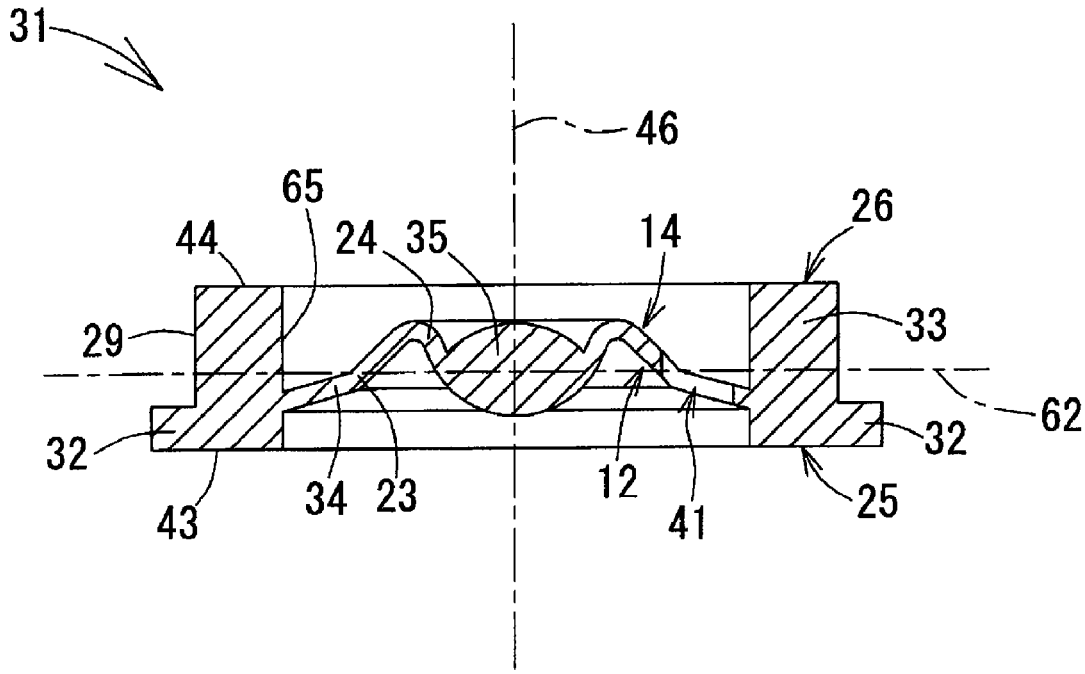
FIG. 7 is a cross sectional view of the first valve element of FIG. 6.

Referring to FIGS. 6 and 7, first valve element 31 may comprise a tube member 33, protrusions 32, an inner wall 34, and a lid member 35.

Tube member 33 may have a circular, cylindrical tube shape. In another embodiment, tube member 33 may have a rectangular, cylindrical tube shape. Tube member 33 may comprise a first surface 25 at a first end 43 of tube member 33 and a second surface 26 at a second end 44 of tube member 33. Each of first surface 25 and second surface 26 may be a planar surface. Referring to FIG. 4, first surface 25 may contact end wall 53, and second surface 26 may contact valve seat 37. Tube member 33 may receive a biasing force from coil spring 96 via valve seat 37. The biasing force may bring first surface 25 of tube member 33 into tight contact with end wall 53, and may bring second surface 26 of tube member 33 into tight contact with valve seat 37. Referring to FIGS. 6 and 7, tube member 33 may comprise an outer peripheral surface 29 having a circular, cylindrical shape, and inner surface 65 having a circular, cylindrical shape. Tube member 33 may have a central axis 46 which extends in depth direction 57.

Protrusions 32 may extend from outer peripheral surface 29 of tube member 33 adjacent to first end 43 of tube member 33. In this embodiment, four projections 32 may be positioned symmetrically with respect to central axis 46. Protrusions 32 may extend from outer peripheral surface 29 of tube member 33 outwardly in radial directions of tube member 33, and protrusions 32 may be perpendicular to central axis 46.

Referring to FIGS. 6 and 7, inner wall 34 may be positioned in the interior of tube member 33, and may extend from inner surface 65 of tube member 33 in a direction intersecting central axis 46 of tube member 33. Inner wall 34 may be connected to inner surface 65 of tube member 33 at a position closer to first end 43 of tube member 33 than to second end 44 of tube member 33. Inner wall 34 may be integral with tube member 33 and lid member 35. Inner wall 34 may comprise a first portion 23 and a second portion 24. First portion 23 may extend from inner surface 65 of tube member 33 toward central axis 46 of tube member 33 and toward second surface 26. First portion 23 may be inclined toward second surface 26 with respect to a direction perpendicular to central axis 46, i.e., the horizontal direction in FIG. 7. Second portion 24 may be connected to first portion 23 and may extend toward first surface 25 to a position adjacent to central axis 46 of tube member 33. Second portion 24 may be inclined toward first surface 25 with respect to the direction perpendicular to central axis 46, i.e., the horizontal direction in FIG. 7. Inner wall 34 may be bent at an intersection between second portion 24 and first portion 23. An acute angle may be formed between first portion 23 and second portion 24. A cross-sectional shape of inner wall 34 in a plane on which central axis 46 lies may be bent. Inner wall 34 may comprise a first surface 12 facing first end 43 of tube member 33, and a second surface 14 facing second end 44 of tube member 33. Each of first surface 12 and second surface 14 may be asymmetrical with respect to an intersecting plane 62, and intersecting plane 62 may be perpendicular to central axis 46 and may intersect a middle portion of tube member 33 between first end 43 and second end 44 of tube member 33. In another embodiment, the inner wall 34 may have a shape similar to an accordion.

In an embodiment, inner wall 34 may be a thin wall comprising an elastic material, such as silicon rubber, such that inner wall 34 is flexible and elastic. Inner wall 34 readily may be deformed upon reception of pressure from ink, and may be restored to its original shape when such pressure is removed. Accordingly, lid member 35 may be configured to selectively move toward opening 28 and away from opening 28 in accordance with the deformation of inner wall 34.

Figure 8A:
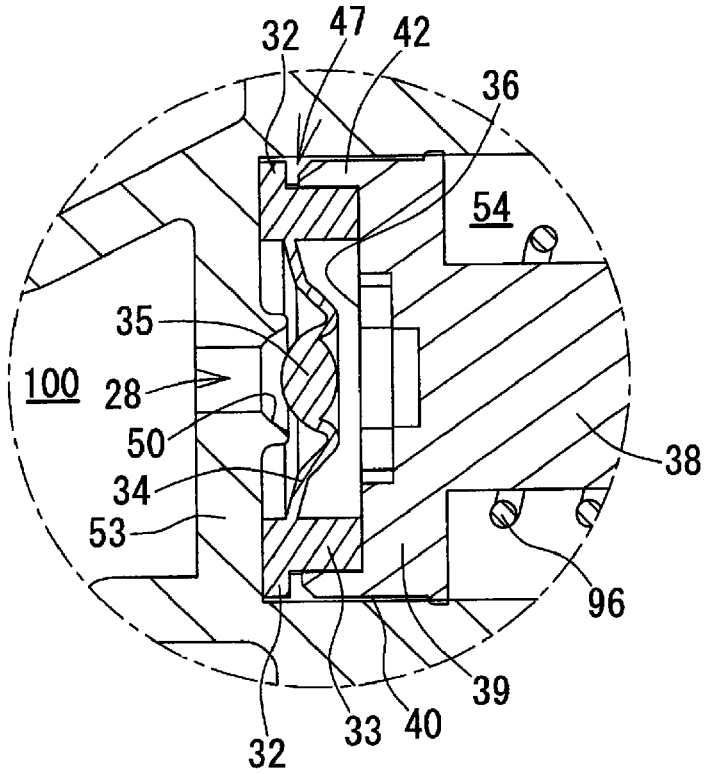
FIGS. 8(A) and 8(B) are partial, cross-sectional view of the case of FIG. 2, showing a structure adjacent to an end wall, in which an opening formed through the end wall is uncovered and covered, respectively.
Figure 8B:
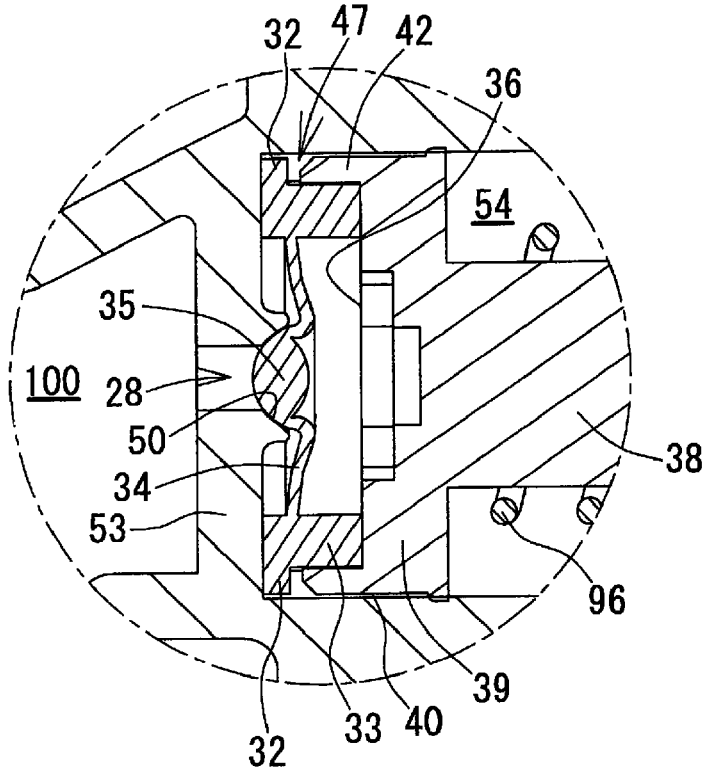

Lid member 35 may be positioned at the center of inner wall 34. Lid member 35 may intersect central axis 46 of tube member 33. Lid member 35 may be configured to selectively cover and uncover opening 28 of end wall 53. The interior of tube member 33 may be divided by inner wall 34 and lid member 35 into two spaces, e.g., a first space formed at a first end 43 side and a second space formed at a second end 44 side. Referring to FIGS. 8(A) and 8(B), end wall 53 may comprise a curved surface 50 extending from a surface contacting tube member 33 to opening 28. Lid member 35 may have a spherical shape or an oval, spherical shape, matching the shape of curved surface 50. The center of gravity of lid member 35 may intersect central axis 46 of tube member 33. Lid member 35 may contact curved surface 50 tightly, such that opening 28 is covered by lid member 35. A cross sectional shape of lid member 35 may be oval or circular. The size of lid member 35 may be determined according to the size of opening 28. The shape of inner wall 34 on a first surface 12 side may match the shape of end wall 53 in the periphery of opening 28. When inner wall 34 receives pressure from ink, lid member 35 may move along central axis 46 of tube member 33.

Referring to FIGS. 6 and 7, an opening 41 may be formed through inner wall 34 in a direction parallel to central axis 46. Opening 41 may extend from first surface 12 of inner wall 34 to second surface 14 of inner wall 34. Ink may pass through opening 41 when ink flows from ink chamber 100 into valve chamber 54. Opening 41 may be positioned further from central axis 46 than lid member 35 is positioned from central axis 46 in the radial direction of tube member 33. By changing the size of opening 41, the flow rate of ink flowing between ink chamber 100 and valve chamber 54 also may be changed. In an embodiment, one opening 41 may be formed through inner wall 34. In another embodiment, a plurality of openings 41 may be formed through inner wall 34. Nevertheless, when the number of openings 41 increases, the pressure that inner wall 34 receives from ink may decrease, such that the sensitivity of first valve element 31 responding to a pressure differential between ink chamber 100 and valve chamber 54 may decrease. Therefore, the number of openings 41 formed through linear wall 34 may correspond to a desired sensitivity to first valve element 31 and a desired flow rate of ink.

First valve element 31 may be asymmetrical with respect to intersecting plane 62. Intersecting plane 62 may be perpendicular to central axis 46 of tube member 33 and may intersect a middle portion of tube member 33 between first end 43 and second end 44 of tube member 33.

Referring to FIGS. 4, 8(A), and 8(B), valve seat 37 may be manufactured by injection-molding polypropylene resin. Valve seat 37 may comprise a valve seat base portion 38 and a valve element receiving portion 39. Valve seat base portion 38 may have a circular, cylindrical rod shape extending from the center of a circular surface of valve element receiving portion 39 in depth direction 57. The outer diameter of the valve seat base portion 38 may be slightly smaller than the inner diameter of coil spring 96. Valve seat base portion 38 may be inserted into coil spring 96. Accordingly, coil spring 96 may be supported by the valve seat base portion 38, such that coil spring 96 is configured to expand and contract in the direction in which valve seat base portion 38 extends, i.e., in depth direction 57. An end of coil spring 96 may contact the circular surface of valve element receiving portion 39.

Valve element receiving portion 39 may receive and contact first valve element 31. Valve element receiving portion 39 may have a circular, cylindrical shape. The outer diameter of valve element receiving portion 39 may be slightly less than the diameter of valve chamber 54. Valve element receiving portion 39 may have a circular, cylindrical recess 36 formed therein. Tube member 33 of first valve element 31 may be positioned in recess 36, such that second surface 26 contacts the bottom of recess 36. The diameter of recess 36 may be slightly greater than the outer diameter of tube member 33 of first valve element 31. The depth of recess 36 may be substantially equal to the thickness of tube member 33 in a direction parallel to central axis 46, i.e., in depth direction 57.

Valve element receiving portion 39 may comprise a peripheral wall 42 defining recess 36 therein, and engaging grooves 47 may be formed in peripheral wall 42. Engaging groove 47 may be recessed from an end of peripheral wall 42 toward the bottom of recess 36 in depth direction 57. Protrusions 32 may be positioned in engaging grooves 47. In an embodiment, four engaging grooves 47 may be provided corresponding to four protrusions 32. Accordingly, the rotation of first valve element 31 with respect to valve element receiving portion 39 may be prevented, and first valve element 31 may be securely held in valve element receiving portion 39. Protrusion 32 may not protrude outwardly from an outer surface 40 of peripheral wall 42 of valve element receiving portion, and therefore, may not contact an inner surface of valve chamber 54. An opening may be formed through the bottom of recess 36, such that ink may pass therethrough. Valve seat 37 may press tube member 33 of first valve element 31 toward end wall 53 when valve seat 37 receives the biasing force of coil spring 96, such that first surface 25 of tube member 33 contacts end wall 53 tightly, and second surface 26 of tube member contacts the bottom of recess 36 tightly.

Referring to FIG. 8(B), when ink in valve chamber 54 flows toward ink chamber 100, the ink may press inner wall 34 of first valve element 31, such that inner wall 34 deforms to move lid member 35 toward opening 28. When lid member 35 contacts curved surface 50 of end wall 53 and covers opening 28, ink may be prevented from flowing from valve chamber 54 to ink chamber 100. Therefore, when the pressure in valve chamber 54 is greater than the pressure in ink chamber 100, lid member 35 may contact curved surface 50 of end wall 53 and may cover opening 28.

Referring to FIG. 8(A), when ink in ink chamber 100 flows into valve chamber 54, the ink may flow through opening 28 and apply a force to lid member 35 and inner wall 34, such that inner wall 34 deforms to move lid member 35 away from end wall 53. Accordingly, opening 28 may be uncovered. As such, ink may flow from ink chamber 100 into valve chamber 54 via opening 28, opening 41, and the opening formed through the bottom of recess 36. Therefore, when the pressure in ink chamber 100 is greater than the pressure in valve chamber 54, lid member 35 may move away from end wall 53, and opening 28 may be uncovered.

Referring to FIG. 4, second valve element 97 may be configured to move in depth direction 57. Second valve element 97 may comprise a wall 78 configured to contact seal member 93. Coil spring 96 may be positioned between valve element receiving portion 39 of valve seat 37 and wall 78 of second valve element 97 while being compressed. Coil spring 96 may bias valve element receiving portion 39, such that tube member 33 of first valve element 31 contacts end wall 53 tightly. Coil spring 96 may bias second valve element 97 toward sealing member 93, such that wall 78 of second valve element 97 contacts sealing member 93.

Sealing member 93 may comprise an elastic material, such as rubber, such that sealing member 93 is configured to elastically deform. Sealing member 93 may comprise a first circular, cylindrical portion 72 fitted into valve chamber 54 via opening 92, and a second circular, cylindrical portion 73 which is in contact with end 155 of ink supply wall 99 defining opening 92. The outer diameter of first circular, cylindrical portion 72 may be substantially equal to the diameter of valve chamber 54. The outer diameter of second circular, cylindrical portion 73 may be greater than the diameter of valve chamber 54, and may be substantially equal to the inner diameter of an inner surface 112 of cap 95. Cap 95 may be attached to case 20, such that cap 95 presses sealing member 93 against end 155 of ink supply wall 99 defining opening 92. Accordingly, sealing member 93 may elastically deform and contact end 155 of ink supply wall 99 liquid tightly. Moreover, because second circular, cylindrical portion 73 is sandwiched and pressed between cap 95 and end 155 of ink supply wall 99, second circular, cylindrical portion 73 may elastically expand, such that the diameter thereof increases. Accordingly, an outer surface 76 of second circular, cylindrical portion 73 may contact inner surface 112 of cap 95 liquid tightly.

An ink supply opening 91 may be formed through the center of first circular, cylindrical portion 72 and the center of second circular, cylindrical portion 73. Opening 91 may have substantially a circular, conical shape. Coil spring 96 may bias second valve element 97 toward sealing member 93, such that wall 78 of second valve element 97 contacts sealing member 93 and covers opening 91. Therefore, fluid communication between the interior of ink chamber 100 and the exterior of case 20 via opening 91 and valve chamber 54 may be prevented. When an external force is applied to second valve element 97 against the biasing force of coil spring 96, second valve element 97 may move away from sealing member 93, and opening 91 may be uncovered. Consequently, fluid communication between the interior of ink chamber 100 and the exterior of case 20 via opening 91 and valve chamber 54 may be allowed.

Cap 95 may comprise a cap body 113 and engaging members 115. An opening 111 may be formed through cap body 113. Opening 92 and opening 111 may be aligned in depth direction 57.

Cap body 113 may have substantially a circular, cylindrical shape. Engaging members 115 may extend from an outer surface of cap body 113.

Cap body 113 may cover outer peripheral surface 76 of second circular, cylindrical portion 73 of sealing member 93 and a portion of an outer surface of ink supply wall 99. In an embodiment, two engaging members 115 may be positioned at different positions on the outer surface of cap body 113, such that the central axis of cap body 113 is positioned between the two engaging members 115. Engaging members 115 each may comprise an elastically deforming portion 135 and a hook portion 136. Elastically deforming portion 135 may have substantially an L-shape. Elastically deforming portion 135 may have a first portion which extends outward from the outer surface cap body 113 in a radial direction of cap body 113, which is perpendicular to depth direction 57, and a second portion which extends toward an end of cap 95 in depth direction 57. Hook portion 136 may extend outward in the radial direction of cap body 113 from an end of elastically deforming portion 135. Elastically deforming portion 135 may be configured to elastically deform to bend with respect to the outer surface of cap body 113, such that hook portion 136 selectively moves outward and inward in the radial direction of cap body 113.

Referring to FIG. 4, case 20 may comprise engaging portions 107 and 109 at front face 102 at positions corresponding to hook portions 136 of cap 95, respectively. Hook portions 136 may engage engaging portions 107 and 109, respectively. Engaging portion 107 may extend toward bottom face 104 and toward outer surface 63 of ink supply wall 99 from a wall 108 extending from front face 102. Engaging portion 109 may extend toward top face 102 and toward outer surface 63 of ink supply wall 99 from a wall 129 extending from front face 102.

When ink cartridge 10 is manufactured, cap 95 may be pressed toward front face 102, and hook portions 136 may be pressed against engaging portions 107 and 109. When this occurs, elastically deforming portions 135 may elastically deform toward outer surface 63 of ink supply wall 99, and hook portions 136 may move over engaging portions 107 and 109. When cap 95 is further pressed toward front face 102, hook portions 136 may return to their original positions by the elasticity of the elastically deforming portions 135, such that hook portions 136 and engaging portions 107 and 109 engage. Accordingly, cap 95 is attached to case 20, such that ink supply wall 99 is positioned between engaging members 115 in height direction 52. One of engaging members 115 may be in a position 148 between ink supply wall 99 and top face 103, and the other of engaging member 115 may be in a position 149 between ink supply wall 99 and bottom wall 104.

Referring to FIGS. 1(A) and 1(B), when first cover 21 is in the first position, cap 95 may be positioned in the interior of first cover 21, as shown in FIG. 1(B). When first cover 21 moves from the first position to the second position, cap 95 may pass through opening 19, and when first cover 21 is in the second position, cap 95 may be positioned outside first cover 21, as shown in FIG. 1(A). The diameter of opening 19 may be slightly greater than the outer diameter of second peripheral wall 127 of cap 95.

Referring to FIG. 3, case 20 may comprise air communication wall 199 extending away from a predetermined portion of front face 102 in depth direction 57. The predetermined portion of front face 102 may be positioned closer to top face 103 than to bottom face 104. Air communication wall 199 may have a tube shape, e.g., a circular, cylindrical tube shape. Valve chamber 55 may be formed in air communication wall 199, and valve chamber 55 may extend from the interior of air communication wall 199 to the interior of case 20 beyond front face 102. Valve chamber 55 may extend in depth direction 57. In an embodiment, valve chamber 55 may have a circular, cylindrical shape. Valve chamber 55 may be configured to be in fluid communication with ink chamber 100. At least a portion of air communication valve mechanism 80 may be accommodated in valve chamber 55.

An opening 82 may be formed at and through an end of air communication wall 199. Air communication valve mechanism 80 may be configured to selectively allow and prevent fluid communication between the interior of ink chamber 100 and the exterior of case 20 via opening 82 and valve chamber 55. Air communication valve mechanism 80 may comprise a coil spring 86, a valve element 87, a sealing member 83, and a cap 85. Each of coil spring 86, valve element 87, sealing member 83, and cap 85 may comprise a resin, such as polyacetal or silicon rubber.

Coil spring 86, valve element 87, sealing member 83, and cap 85 may be sequentially aligned in depth direction 53 and may contact each other. Coil spring 86 and valve element 87 may be accommodated in valve chamber 55. Sealing member 83 and cap 85 may be positioned at a portion of air communication wall 199 defining opening 82.

Valve element 87 may be configured to move in depth direction 57. Valve body 87 may comprise a lid member 88 and a rod 84. Rod 84 may extend from the center of lid member 88 to the exterior of case 20 via opening 82. Cap 85 may be attached to front face 102, such that sealing member 83 is sandwiched between cap 85 and the portion of air communication wall 199 defining opening 82. Each of cap 85 and sealing member 83 may have an opening formed therethrough. Rod 84 also may extend via the openings of cap 85 and sealing member 83.

Coil spring 86 may be configured to apply a biasing force to valve element 87 toward sealing member 83. Therefore, lid member 88 may contact sealing member 83 and cover the opening of sealing member 83, such that fluid communication between the interior of ink chamber 100 and the exterior of case 20 via opening 82 and valve chamber 55 is prevented. When an external force is applied to rod 84 against the biasing force of coil spring 86, rod 84 may move toward valve chamber 55. Accordingly, lid member 88 of valve element 87 may move away from sealing member 83, and the opening of sealing member 83 may be uncovered. Consequently, fluid communication between the interior of ink chamber 100 and the exterior of case 20 via opening 82 and valve chamber 55 may be allowed. When this occurs, air may flow into ink chamber 100 via opening 82 and valve chamber 55, and consequently, the pressure in ink chamber 100 may become equal to the atmospheric pressure.

Referring to FIGS. 1(A) and 1(B), when first cover 21 is in the first position, rod 84 may be positioned in the interior of first cover 21 away from front wall 161. When first cover 21 moves from the first position to the second position, rod 84 may contact front wall 161 and may be pressed toward valve chamber 55. When first cover 21 is in the second position, that lid member 88 of valve element 87 may be positioned away from sealing member 83, and the opening of sealing member 83 may be uncovered.

When ink cartridge 10 is inserted into the mounting portion, first cover 21 may contact a particular portion of the mounting portion and may be pressed against the particular portion of the mounting portion, such that first cover 21 moves from the first position to the second position. When this occurs, rod 84 may be pressed by first cover 21, such that lid member 88 of valve element 87 moves away from sealing member 83, and the opening of sealing member 83 is uncovered. Consequently, fluid communication between the interior of ink chamber 100 and the exterior of case 20 via opening 82 and valve chamber 55 may be allowed. Moreover, referring to FIG. 5, cap 95 may emerge from the interior of first cover 21 and be exposed to the exterior of first cover 21, and an ink tube 49 positioned in the mounting portion may be inserted into opening 111 of cap 95. The outer diameter of ink tube 49 may be less than the diameter of opening 111.

When ink cartridge 10 is further inserted into the mounting portion, ink tube 49 may be inserted into ink supply opening 91, and an end of ink tube 49 may contact second valve element 97. The diameter of ink tube 49 may be greater than the smallest diameter of ink supply opening 91. Therefore, when ink tube 49 is inserted into ink supply opening 91, sealing member 93 may elastically deform and contact the outer surface of ink tube 49 liquid-tightly. When ink cartridge 10 is further inserted into the mounting portion, second valve element 97 may be pressed by ink tube 49 against the biasing force of coil spring 96, and may move away from sealing member 93. Accordingly, ink supply opening 91 is uncovered. When this occurs, ink tube 49 may enable valve chamber 54 to be in fluid communication with the exterior of case 20 via ink supply opening 91 and opening 110, such that ink in the ink chamber 100 may be allowed to be supplied to the recording head via an ink path 120 extending via opening 28, opening 41, the opening of valve element receiving portion 39, valve chamber 54, and ink tube 49.

As described above, the cross sectional shape of inner wall 34 in the plane on which central axis 46 lies may be bent. Therefore, inner wall 34 may deform when a relatively weak force is applied to inner wall 34, and lid member 35 may move along central axis 46 when there is a relatively small pressure differential between ink chamber 100 and valve storage chamber 54, i.e., the response of first valve element 31 to the pressure differential may become sensitive.

In an embodiment, because protrusions 32 are positioned on outer peripheral surface 29 of tube member 33 adjacent to first end 43 of tube member 33, first valve element 31 may be configured to be positioned in recess 36 via the second end 44 side, and not to be positioned in recess 36 via the first end 43 side. Therefore, first valve element 31 may be prevented from being inserted into valve element receiving portion 39 in an incorrect position.

While the invention has been described in connection with various exemplary structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. A valve mechanism comprising:

a particular wall having a first opening formed therethrough;

a tube member comprising:

a particular surface which contacts the particular wall; and a central axis;

a lid member configured to selectively cover and uncover the first opening; and a flexible inner wall positioned in an interior of the tube member, wherein the flexible inner wall extends from the tube member to the lid member in a direction which intersects the central axis, and the flexible inner wall has a second opening formed therethrough, wherein a cross-sectional shape of the flexible inner wall in a particular plane is bent, and the central axis lies on the particular plane.

2. The valve mechanism of claim 1, wherein the flexible inner wall comprises an elastic material.

3. The valve mechanism of claim 1, wherein the lid member intersects the central axis.

4. The valve mechanism of claim 1, wherein the lid member comprises one of a spherical portion and an oval, spherical portion.

5. The valve mechanism of claim 1, wherein the flexible inner wall comprises:

a first portion extending from the tube member;

a second portion extending from the first portion to the lid member, wherein an angle between the first portion and the second portion is an acute angle.

6. The valve mechanism of claim 1, wherein the tube member comprises a first end and a second end opposite the first end, and the particular surface is positioned at the first end, wherein the interior of the tube member is partitioned by the flexible inner wall and the lid member into a first space adjacent to the first end and a second space adjacent to the second end.

7. The valve mechanism of claim 6, wherein the flexible inner wall comprises a first surface facing the first end of the tube member, and a second surface facing the second end of the tube member, wherein each of the first surface and the second surface of the flexible inner wall is asymmetrical with respect to a plane which is perpendicular to the central axis and intersects a middle portion of the tube member between the first end and the second end of the tube member.

8. The valve mechanism of claim 6, wherein the flexible inner wall is connected to the tube member at a particular position which is closer to the first end of the tube member than to the second end of the tube member.

9. The valve mechanism of claim 1, further comprising a receiving member having a recess formed therein, wherein the tube member is positioned in the recess.

10. The valve mechanism of claim 9, wherein the tube member comprises:

a first end, wherein the particular surface is positioned at the first end;

a second end opposite the first end;

an outer peripheral surface extending between the first end and the second end; and at least one protrusion extending from the outer peripheral surface in a radial direction of the tube member, wherein the at least one protrusion is perpendicular to the central axis, and is adjacent to the first end, wherein the receiving member has at least one groove formed therein, and the at least one protrusion is positioned in the at least one groove.

11. The valve mechanism of claim 1, wherein the second opening is offset from the central axis.

12. An ink cartridge comprising:

an ink chamber configured to store ink therein;

a particular chamber configured to supply ink from an interior of the ink chamber to the exterior of ink chamber therethrough;

a particular wall having a first opening formed therethrough, wherein the ink chamber and the particular chamber are divided by the particular wall;

a tube member comprising:

a particular surface which contacts the particular wall; and a central axis;

a lid member configured to selectively cover and uncover the first opening; and a flexible inner wall positioned in an interior of the tube member, wherein the flexible inner wall extends from the tube member to the lid member in a direction which intersects the central axis, and the flexible inner wall has a second opening formed therethrough, wherein a cross-sectional shape of the flexible inner wall in a particular plane is bent, and the central axis lies on the particular plane.

13. The ink cartridge of claim 12, wherein the flexible inner wall comprises an elastic material.

14. The ink cartridge of claim 12, wherein the lid member intersects the central axis.

15. The ink cartridge of claim 12, wherein the lid member comprises one of a spherical portion and an oval, spherical portion.

16. The ink cartridge of claim 12, wherein the flexible inner wall comprises:

a first portion extending from the tube member;

a second portion extending from the first portion to the lid member, wherein an angle between the first portion and the second portion is an acute angle.

17. The ink cartridge of claim 12, wherein the tube member comprises a first end and a second end opposite the first end, and the particular surface is positioned at the first end, wherein the interior of the tube member is partitioned by the flexible inner wall and the lid member into a first space adjacent to the first end and a second space adjacent to the second end.

18. The ink cartridge of claim 17, wherein the flexible inner wall comprises a first surface facing the first end of the tube member, and a second surface facing the second end of the tube member, wherein each of the first surface and the second surface of the flexible inner wall is asymmetrical with respect to a plane which is perpendicular to the central axis and intersects a middle portion of the tube member between the first end and the second end of the tube member.

19. The ink cartridge of claim 17, wherein the flexible inner wall is connected to the tube member at a particular position which is closer to the first end of the tube member than to the second end of the tube member.

20. The ink cartridge of claim 12, further comprising a receiving member having a recess formed therein, wherein the tube member is positioned in the recess.

21. The ink cartridge of claim 20, wherein the tube member comprises:

a first end, wherein the particular surface is positioned at the first end;

a second end opposite the first end; an outer peripheral surface extending between the first end and the second end; and at least one protrusion extending from the outer peripheral surface in a radial direction of the tube member, wherein the at least one protrusion is perpendicular to the central axis, and is adjacent to the first end, wherein the receiving member has at least one groove formed therein, and the at least one protrusion is positioned in the at least one groove.

22. The ink cartridge of claim 12, wherein the second opening is offset from the central axis.

* * * * *